US007802689B2

(12) United States Patent
Kanjo

(10) Patent No.: US 7,802,689 B2
(45) Date of Patent: Sep. 28, 2010

(54) ARTICULATED COUPLING APPARATUS

(75) Inventor: Wajih Kanjo, Lockport, IL (US)

(73) Assignee: WABTEC Holding Corp, Wilmerding, PA (US)

( * ) Notice: Subject to any disclaimer, the term of this patent is extended or adjusted under 35 U.S.C. 154(b) by 230 days.

(21) Appl. No.: 11/891,875

(22) Filed: Aug. 14, 2007

(65) Prior Publication Data

US 2008/0035595 A1 Feb. 14, 2008

Related U.S. Application Data

(60) Provisional application No. 60/837,527, filed on Aug. 14, 2006.

(51) Int. Cl.
*B61G 1/00* (2006.01)

(52) U.S. Cl. ..... 213/61; 213/62 A; 213/62 R; 213/75 R

(58) Field of Classification Search ..... 213/62 R, 213/64, 65, 75 R, 77, 61
See application file for complete search history.

(56) References Cited

U.S. PATENT DOCUMENTS 2,064,126 A * 12/1936 Schellens et al. ..... 110/162
3,138,115 A * 6/1964 Waite ..... 105/136
3,646,604 A 2/1972 Tack et al.
5,000,330 A * 3/1991 Kaim et al. ..... 213/62 R
5,172,819 A * 12/1992 Daugherety, Jr. et al. .. 213/75 R
5,547,089 A * 8/1996 Daugherty Jr. et al. .... 213/62 R
5,702,012 A * 12/1997 Kanjo ..... 213/62 R
5,707,168 A * 1/1998 Sharon ..... 403/362
6,564,956 B2 * 5/2003 Daugherty, Jr. ..... 213/75 R
6,718,836 B2 * 4/2004 Revelis et al. ..... 74/89.23

FOREIGN PATENT DOCUMENTS

EP 0701938 A 3/1996

* cited by examiner

*Primary Examiner*—S. Joseph Morano
*Assistant Examiner*—Zachary Kuhfuss
(74) *Attorney, Agent, or Firm*—James Ray & Assoc

(57) ABSTRACT

An articulated coupling apparatus utilized in connecting together, in a substantially semi-permanent fashion, adjacently disposed ends of a pair of railway cars includes male and female connection members. A front and rear followers, each having a spherical cavity, are positioned within the female connection member. First and second lubricating liners are positioned within such spherical cavities and a spherical member is operably caged between such lubricating liners. A shaft is attached to the spherical member and extends outwardly from the female connection member for secure connection to the male connection member. A pair of wedges are mounted adjacent the rear surface of the rear follower and exert a force onto such rear follower moving it toward the spherical member and further toward the front follower to compensate for wear of the mating spherical surfaces during service and to prevent formation of a gap between the mating surfaces.

21 Claims, 4 Drawing Sheets

ARTICULATED COUPLING APPARATUS

CROSS-REFERENCE TO RELATED APPLICATIONS

This application is related to and claims priority from Provisional Patent Application Ser. No. 60/837,527 filed Aug. 14, 2006.

FIELD OF THE INVENTION

This invention relates, in general, to articulated coupling arrangements used to connect one end of a first railway car to an adjacent end of a second railway car in a substantially semi-permanent fashion and, more particularly, the present invention relates to an articulated coupling apparatus which offers improved performance and reliability during service by internally compensating for deterioration of the bearing surfaces.

BACKGROUND OF THE INVENTION

The following background information is provided to assist the reader in understanding the environment in which the invention will typically be used. The terms used herein are not intended to be limited to any particular narrow interpretation unless specifically stated otherwise in this document.

Articulated coupling arrangements are well known in the railroad industry as the means to connect together the adjacently disposed ends of a pair of railway cars in a substantially semi-permanent fashion.

Essentially, the articulated coupling apparatus includes a female connection member and a male connection member. Each member has one end thereof being engaged with and connected to an end of a center sill member of a respective railway car. Prior to the conception and development of the present invention, the opposed ends of each member were operably interconnected therebetween by way of a bearing assembly that typically includes a spherical ball member and bearing races for improving performance of the articulated coupling apparatus.

As it is also well known, prior art articulated coupling apparatus must be periodically reconditioned during service by replacing the bearing races due to deterioration of their surfaces during railway car service.

It has been found that during operation and use of the prior art articulated coupling apparatus, deterioration of the bearing race surfaces propagates a gap which forms between the inner surfaces of the bearing races and the outer surface of the spherical bearing and which incrementally increases during use. Such gap adversely affects operation of the articulated coupling apparatus until such reconditioning effort occurs.

Therefore, it is desirable to provide reliable and economical articulated coupling apparatus which compensates for wear and deterioration of mating bearing surfaces and prevents formation of a gap therebetween during service.

SUMMARY OF THE INVENTION

The present invention provides an articulated coupling apparatus utilized in connecting together, in a substantially semi-permanent fashion, adjacently disposed ends of a pair of railway cars. The articulated coupling apparatus includes a female connection member. The female connection member is formed by a first end configured to be engaged with and connected to one predetermined end of a center sill member disposed substantially along a longitudinal centerline of one of such pair of railway cars and by an elongated hollow second end. The second end is substantially axially aligned with the first end of the female connection member. The second end has a first portion which is secured to the first end of the female connection member and a second portion which is connected in open communication to the first portion and which extends axially therefrom in a direction away from the first end. There is a first aperture which is formed through a planar wall portion which closes the second portion of the second end and which is disposed generally vertically when the female connection member is installed for connecting such pair of railway cars and generally perpendicular to such longitudinal centerline of such one of such pair of railway cars. The first aperture has each of a first predetermined size and a first predetermined shape. A second aperture is formed through a top planar wall portion of the second end. The second aperture has each of a second predetermined size and a second predetermined shape. A rear follower is generally positioned within the second portion of the second end of the female connection member adjacent to and spaced from the first end thereof. The rear follower has a bottom surface which abuttingly engages an inner surface of a bottom wall portion of the second end of the female connection member. A front surface of the rear follower is disposed generally perpendicular to each of the bottom surface and such longitudinal centerline of such one of such pair of railway cars. There is a spherical cavity which is formed in the front surface. An opposed rear surface of the rear follower is positioned towards the first portion of the second end of the female connection member. The rear surface has a pair of spaced apart tapered portions formed thereon in spaced relationship from a top and the bottom surface of the rear follower. The tapered portions are tapered at a predetermined angle downwardly and outwardly in a direction toward the first end of the female connection member. There is also a front follower which is positioned within the second portion of the second end of the female connection member. The front follower has a bottom surface which abuttingly engages the inner surface of the bottom wall portion of the second end of the female connection member. A front surface of the front follower is disposed generally perpendicular to each of the bottom surface of the front follower the longitudinal centerline of one of the railway cars. There is a spherical cavity which is formed in the front surface of the front follower. An opposed rear surface of the front follower abuttingly engages an inner surface of the planar wall portion which closes the second portion of the second end of the of the female connection member. An aperture is formed through the spherical cavity and through the rear surface of the front follower in general alignment with the first aperture of the second end of the female connection member. The articulated coupling apparatus further includes a substantially spherical member which is at least partially positioned in operable relationship within the spherical cavity formed in the front follower and the spherical cavity formed in the rear follower. A shaft member has a first end thereof connected to a portion of an outer surface of the substantially spherical member. The shaft member extends outwardly from the outer surface of the substantially spherical member through each of the aperture formed through the spherical cavity and through the rear surface of the front follower and the first aperture of the second end of the female connection member. The second end of the shaft member is positioned external to the female connection member. The articulated coupling apparatus additionally includes a pair of wedges each having a top end, a bottom end which is spaced from an inner surface of the bottom wall portion of the second end of the female connection member, and a tapered front surface connecting the top and bottom ends and cooperatively engaging a respective one of the pair of spaced apart portions which are formed on the rear surface of the rear follower. A rear surface of the wedge connects the top and bottom ends and abuttingly engaging an inner surface of a wall portion of the first portion of the female connection member which engages the first end of the female connection member. The pair of wedges descend downwardly to force the rear follower and the substantially spherical member toward the front follower and to compensate for longitudinally axial clearances forming due to wear of at least one of the substantially spherical member, the spherical cavity of the front follower and the spherical cavity of the rear follower. Finally, there is a male connection member which has a first end thereof configured to be engaged with and connected to an adjacent predetermined end of a center sill member disposed substantially along a longitudinal centerline of an opposed one of such pair of railway cars. A second end of the male connection member is secured to and substantially axially aligned with the first end of the male connection member. An aperture is formed through the second end of the male connection member for operably receiving the second end of the shaft member. Thus, the substantially spherical member and the shaft member enable swivel movement of the male connection member in relation to the female connection member in both a vertical direction and a horizontal direction over a predetermined range.

OBJECTS OF THE INVENTION

It is, therefore, one of the primary objects of the present invention to provide an articulated coupling apparatus for connecting one end of a first railway car to an adjacent end of a second railway car in a substantially semi-permanent fashion.

Another object of the present invention is to provide an articulated coupling apparatus which compensates for deterioration of mating bearing surfaces and a resulting gap that forms between the mating bearing surfaces during continuous service.

A further object of the present invention is to provide an articulated coupling apparatus which employs wedge members to compensate for deterioration of mating bearing surfaces and a resulting gap that forms between the mating bearing surfaces during continuous service.

Yet a further object of the present invention is to provide an articulated coupling apparatus which is relatively inexpensive to manufacture.

It is an additional object of the present invention to provide an articulated coupling apparatus which can be easily retrofitted into existing railway cars.

Another object of the present invention is to provide an articulated coupling apparatus which is simple to assemble.

In addition to the above-described objects and advantages of the male connection member utilized in an articulated type coupling arrangement, various other objects and advantages of the present invention will become more readily apparent to those persons who are skilled in the railroad coupling art from the following more detailed description of the invention, particularly when such description is taken in conjunction with the attached drawing figures and with the appended claims.

DETAILED DESCRIPTION OF VARIOUS EMBODIMENTS OF THE INVENTION

Figure 1:
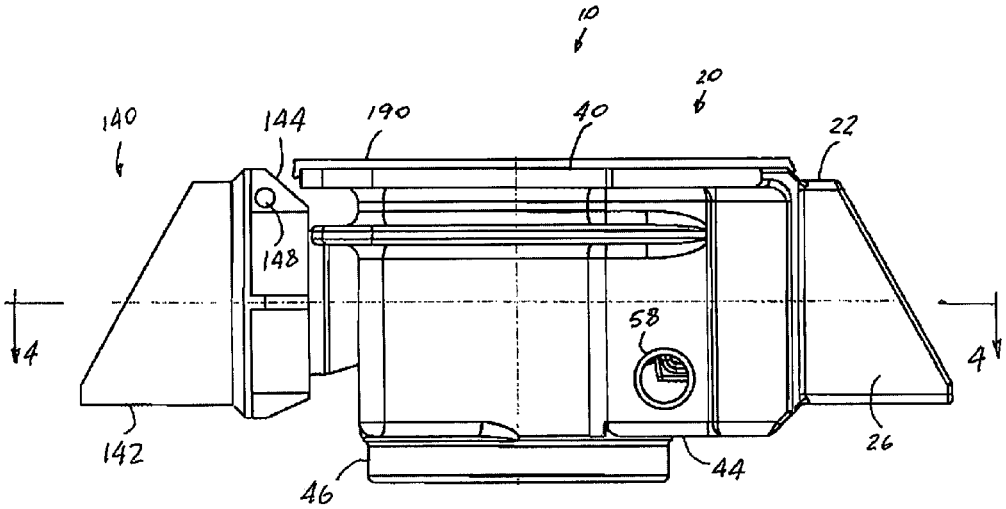
FIG. 1 is a front elevation view of an articulated coupling apparatus of the present invention.
Figure 2:
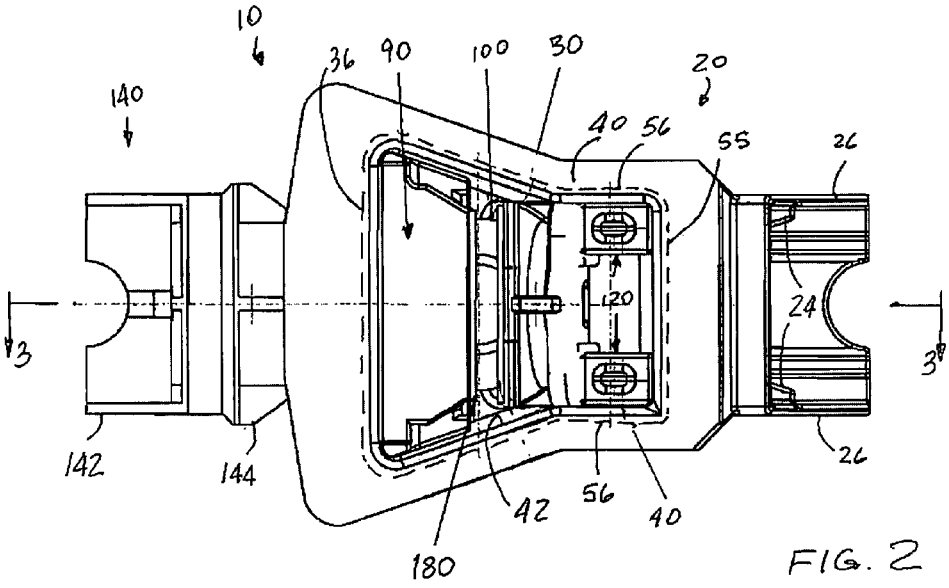
FIG. 2 is a top view of the articulated coupling apparatus of FIG. 1.

Prior to proceeding with the more detailed description of the invention it should be noted that for the sake of clarity and understanding the invention, identical components which have identical functions have been identified with identical reference numerals throughout the several views illustrated in the attached drawing Figures.

The reader's attention is directed to FIGS. 1-12, wherein there is illustrated an articulated coupling apparatus, generally designated as 10, which is utilized in connecting together, in a substantially semi-permanent fashion, adjacently disposed ends of a pair of railway cars (not shown). Now in reference to FIGS. 1-4, the articulated coupling apparatus 10 includes a female connection member, generally designated as 20. The female connection member 20 has a first end 22 which is configured to be engaged with and connected to one predetermined end of a center sill member 2 disposed substantially along a longitudinal centerline of one of such pair of railway cars (not shown) which is also coaxial with a longitudinal axis of the articulated coupling apparatus 10. The first end 22 has a generally tubular shape and may include optional ribs 24 for reinforcing side wall portions 26 of such first end 22.

There is an elongated and hollow second end 30 which is substantially axially aligned with the first end 22 of the female connection member 20. The second end 30 has a first portion 32 which is secured to the first end 22 of the female connection member 20 and a second portion 34 which is connected in open communication to the first portion 32 and which extends axially therefrom in a direction away from the first end 22. The first and second portions 32, 34 respectively, of the second end share a common top planar wall portion 40 and a bottom wall portion 44. Now in a particular reference to FIG. 2, the first portion 32 has a generally U-shaped cross-section of a generally uniform width in the horizontal plane relative to side wall portions 56 while the width of the second portion 34 increases from its connection with the first portion 32 to its outer planar wall portion 36 which closes the second portion 34 and which is disposed generally vertically when the female connection member 20 is installed for connecting such pair of railway cars (not shown) and generally perpendicular to such longitudinal axis of the articulated coupling apparatus 10. The reason for such predetermined shape of the second end 30 of the female connection member 20 is to accommodate movement of such pair of railway cars (not shown) around a curve. It is presently preferred for the female connection member 20 to be manufactured as a single piece member from a steel material by a casting process.

A first aperture 38 is formed through the planar wall portion 36 and has each of a first predetermined size and a first predetermined shape. There is a second aperture 42 which is formed through a top planar wall portion 40 of the second end 30 and which spans along each of the first portion 32 and the second portion 34 of the second end 30. The second aperture 42 has each of a second predetermined size and a second predetermined shape which generally follows the shape of the second end 30. The top planar wall portion 40 may be sized to extend outwardly past the respective vertical wall portions of the second end 30. In a conventional arrangement, the bottom wall portion 44 of the second end 30 of the female connection member 20 includes a center plate member 46 which is substantially round and which matingly engages a center bowl 6 of a bolster portion (not shown) of a railway car truck (not shown) in a conventional fashion. Accordingly, the center plate member 46 includes a vertically disposed hole 48 formed adjacent a bottom surface thereof and substantially in a center thereof. A vertically disposed pin member 8 is received in the hole 48 in the center plate member 46 and a vertically disposed hole 7 in such center bowl 6 of such bolster (not shown). A bore 49 is provided in a bottom surface 50 of the center plate 46 for mating with such bowl 6 of such bolster (not shown). As is well known in the art, each of the bottom surface 50 and a vertically disposed side 52 of the center plate member 46 is a bearing surface which is hardened to at least about 375 Brinell for a depth of about one-eighth inch. It has been found advantageous for the female connection member 20 to include at least one aperture 54 which is formed through the bottom wall portion 44 and, if required through the center plate member 46, for draining liquid matter from the internal confines of the female connection member 20.

Figure 5:
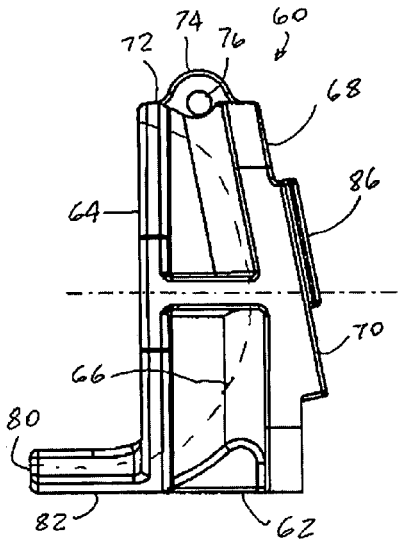
FIG. 5 is a side view of a rear follower which is employed in the articulated coupling apparatus of FIG. 1.
Figure 6:
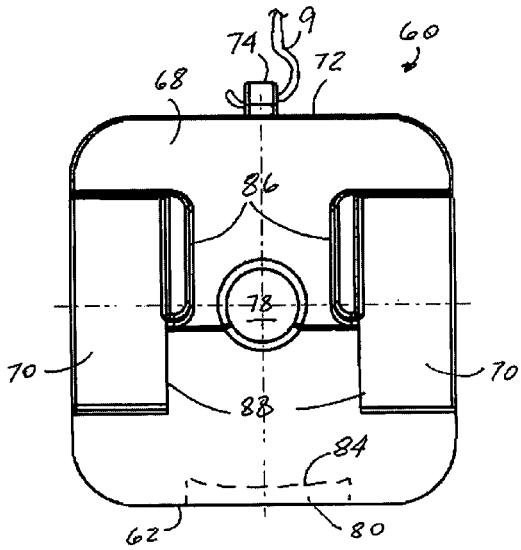
FIG. 6 is a rear view of the rear follower of FIG. 5.

A rear follower, generally designated as 60, best shown in FIGS. 5-6, is generally positioned within the second end 30 of the female connection member 20 adjacent to and spaced from the first end 22 of the female connection member 20. The rear follower 60 has a bottom surface 62 which abuttingly engages an inner surface of the bottom wall portion 44 of the second end 30 of the female connection member 20. A front surface 64 of the rear follower 60 is disposed generally perpendicular to each of the bottom surface 62 and to such longitudinal axis of the articulated coupling apparatus 10. A spherical cavity 66 is formed in the front surface 64. An opposed rear surface 68 of the rear follower 60 is positioned in a direction toward the first portion 32 of the second end 30 and toward the first end 22 of the female connection member 20. Pair of spaced apart tapered portions 70 are formed on the rear surface 68 in spaced relationship from a top surface 72 and the bottom surface 62 of the rear follower 60. The tapered portions 70 are tapered at a predetermined angle downwardly in a direction toward the bottom wall portion 44 and outwardly in a direction toward the first end 22 of the female connection member 20. The rear follower 60 further includes a tab 74 which is formed on the top surface 72 thereof and which extends outwardly from such top surface 72 and an aperture 76 which is formed through the tab 74 for releaseably attaching the rear follower 60 to a lifting implement 9, such as a well known hook, which is connected to a lifting device (not shown) and which is employed when the rear follower 60 is installed into or removed from the second end 30 of the female connection member 20.

Figure 7:
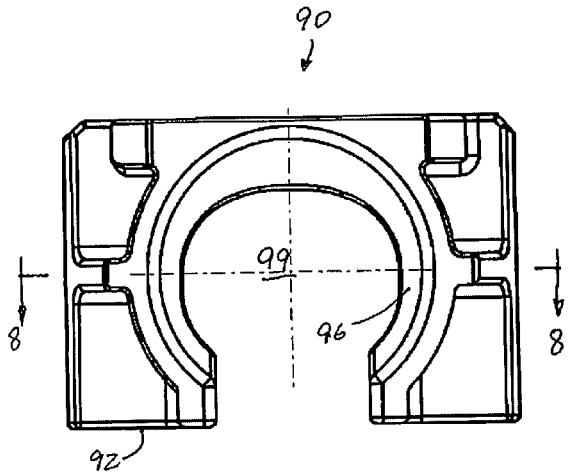
FIG. 7 is a front view of a front follower which is employed in the articulated coupling apparatus of FIG. 1.
Figure 8:
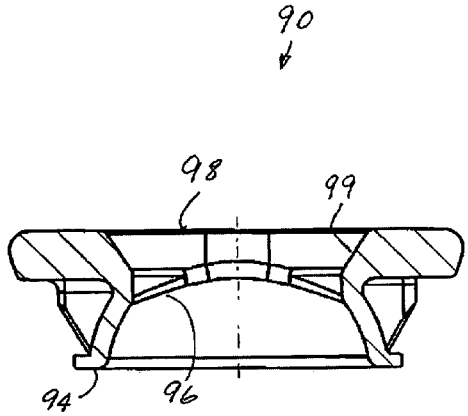
FIG. 8 is a cross-sectional view of the front follower along lines 8-8 of FIG. 7.

A front follower, generally designated as 90, best shown in FIGS. 7-8, is positioned within the second portion 34 of the second end 30 of the female connection member 20 between the rear follower 60 and the planar outer wall portion 36. The front follower 90 has a bottom surface 92 which abuttingly engages the inner surface of the bottom wall portion 44 of the second end 30 of the female connection member 20. A front surface 94 of the front follower 90 is disposed generally perpendicular to each of the bottom surface 92 of the front follower 90 and such longitudinal centerline of such one of such pair of railway cars (not shown). The front surface 94 includes a spherical cavity 96 formed therein. An opposed rear surface 98 of the front follower 90 abuttingly engages an inner surface of the planar wall portion 36 which closes the second portion 34 of the second end 30 of the of the female connection member 20. An aperture 99 is formed through the spherical cavity 96 and through the rear surface 98 of the front follower 90 in open communication with the aperture 38 which is formed in the planar wall portion 36 of the female connection member 20.

A substantially spherical member 100 is at least partially positioned in operable relationship within the spherical cavity 96 of the front follower 90 and the spherical cavity 66 of the rear follower 60. A flat 104 which is formed in the substantially spherical member 100 and which is oriented towards the top of the female connection member 20 is provided for operational clearances during assembly. A shaft member 110 has a first end 112 thereof connected to a portion of an outer surface 102 of the substantially spherical member 100, the shaft member 110 extends outwardly from the outer surface 102 of the substantially spherical member 100 through the aperture 99 formed through the spherical cavity 96 and through the rear surface 98 of the front follower 90 and through the first aperture 38 formed in the planar wall portion 36 of the second end 30 of the female connection member 20. Thus, a second end 114 of the shaft member 110 is positioned external to the female connection member 20. The width of the first aperture 38 and the width of the aperture 99 are preselected to allow movement of the shaft member 110 in the horizontal direction during movement of the pair of railway cars (not shown) around a curve. Likewise, the height of first aperture 38 and the height of the aperture 99 are preselected to allow movement of the shaft member 110 in a vertical direction during movement of the pair of railway cars (not shown) around the curve. Accordingly, the shape of each aperture 38, 98 is predetermined to allow a swivel motion of the shaft member 110 during movement of the pair of railway cars (not shown) around the curve. The presently preferred shape of each aperture 38, 99 is a rectangle having rounded corners. The presently preferred size of the aperture 38 is about 12 inches in width and about 9 inches in height. The presently preferred size of the aperture 99 is about 8.5 inches and the height and about 6.5 inches in height.

Figure 3:
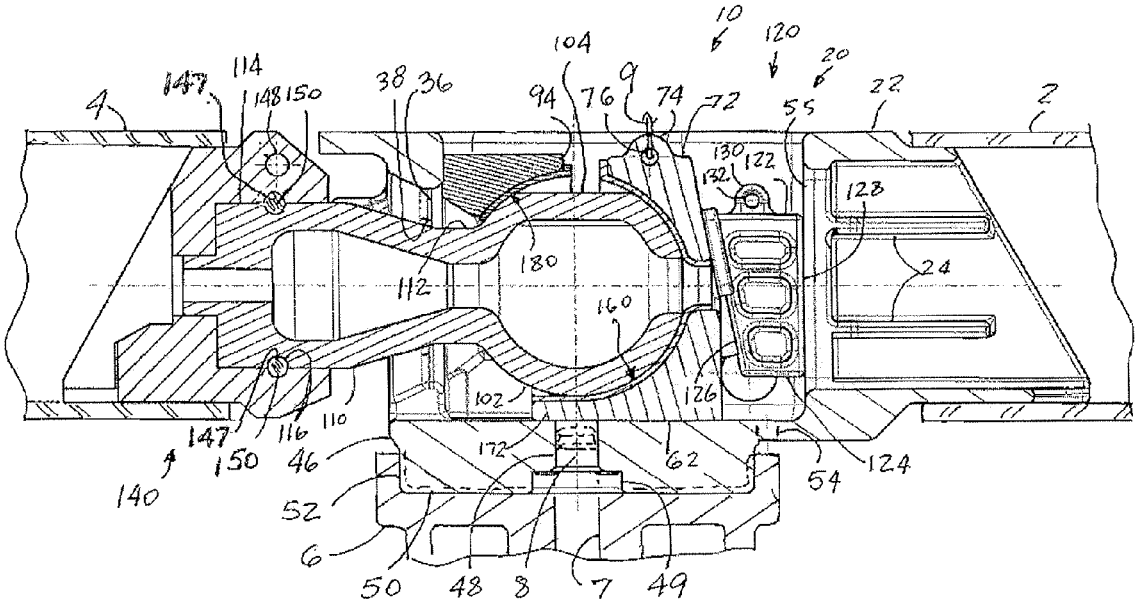
FIG. 3 is a vertical cross-sectional view of the articulated coupling apparatus along lines 3-3 of FIG. 2.
Figure 4:
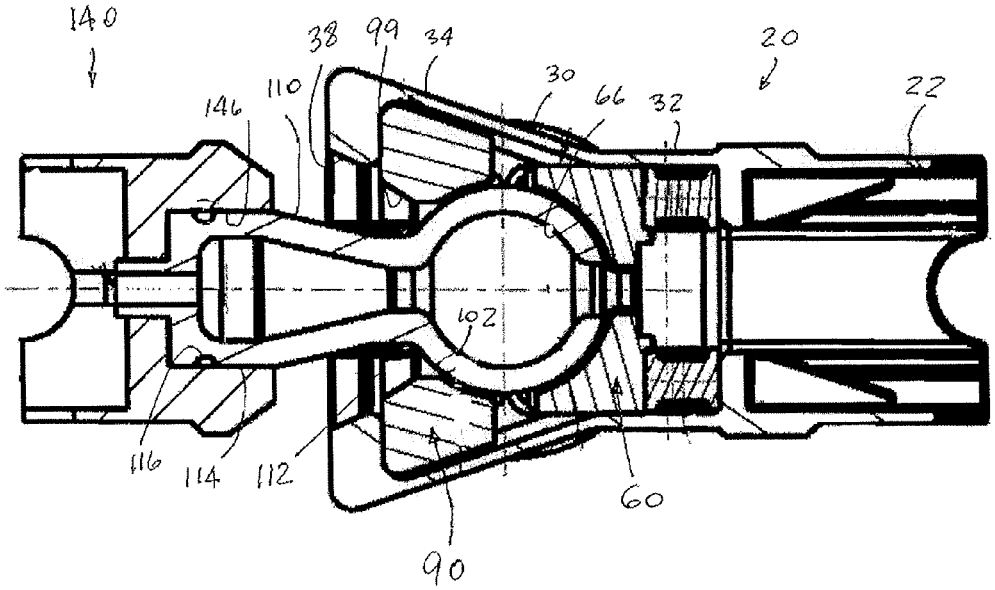
FIG. 4 is a horizontal cross-sectional view of the articulated coupling apparatus along lines 4-4 of FIG. 1.

In a further reference to FIG. 3, the articulated coupling apparatus 10 is provided with a pair of identical wedges, generally designated as 120, which are installed between the rear surface 68 of the rear follower 60 and the first end 22 of the female connection member 20. Each wedge 120 has a top end 122, a bottom end 124 which is spaced from the inner surface of the bottom wall portion 44 of the second end 30 of the female connection member 20 when the wedges 120 are installed into such female connection member 20. A tapered first surface 126 connects the top and bottom ends, 122 and 124 respectively, and cooperatively engages a respective one of the pair of spaced apart tapered portions 70 which are formed on the rear surface 68 of the rear follower 60. A second surface 128 connecting the top and bottom ends, 122 and 124 respectively, of the wedge 120 is vertically disposed and abuttingly engages an inner surface of a wall portion 55 of the first portion 32 of the female connection member 20 which engages the first end 22 of the female connection member 20. Each wedge 120 descends downwardly by any suitable means and, preferably due to gravity, to axially force and move the rear follower 60 and the substantially spherical member 100 in a direction toward the front follower 90 and to compensate for longitudinally axial clearances forming due to wear of at least one of the substantially spherical member 100, the spherical cavity 96 of the front follower 90 and the spherical cavity 66 of the rear follower 60. Since each wedge 120 which is positioned adjacent outer side edges of the rear surface 68 of the rear follower 60, a pair of spaced apart flanges 86 are disposed on and secured to the rear surface 68 of the rear follower 60, each positioned adjacent an interior side edge 88 of a respective one of the pair of tapered portions 70 and wherein each wedge 120 is caged between a respective flange 86 and a respective inner surface of a side wall portion 56 of the second end 30 of the female connection member 20. In such caged arrangement, the wedges 120 are restricted from transverse movement in relationship to such longitudinal axis of the articulated coupling apparatus 10. It must be noted that the side wall portions 56 guide the axial movement of the rear follower 60 which is sized to operatively engage the inner surface of each side wall portion 56. It is also within the scope of the present invention to provide each wedge 120 with a tab 130 which is formed on the top end 122 of wedge 120 and which extends outwardly from the top end 122 and an aperture 132 being formed through the tab 130 for releaseably attaching each wedge 120 to the lifting implement 9 employed when the each wedge is installed into or removed from the second end 30 of the female connection member 20. Preferably the aperture 132 is identical to the aperture 76 formed within the tab 74 of the rear follower 60.

The present invention contemplates employment of cushioning means (not shown) which is disposed between the wedges 120 and the first end 22 of the female connection member 20 to control the force exerted by such wedge members 120 onto the rear coupler 60 during operation of the articulated coupling apparatus 10. Such cushioning means (not shown) may be of an elastomer or bias spring type.

The present invention also contemplates to adapt the female connection member 20 with an aperture 58 which is formed in at least one of side wall portions 56 of the first portion 32 of the second end 30 and which is positioned adjacent and spaced from the bottom wall portion 44 of the second end 30 for facilitating removal of the wedges 120 and for measuring the wear of the at least one of the substantially spherical member 100, the spherical cavity 96 of the front follower 90 and the spherical cavity 66 of the rear follower 60. To remove the wedge 120, an elongated rigid bar (not shown) is inserted through the aperture 58 to contact with the bottom end 124 of the wedge 120 and the force is applied to the free end of the elongated rigid bar (not shown) in a downward direction to move the wedge 120 upwardly when it can be freely removed form the second end 20. When the wedges 120 are removed, the rear follower 60 is moved back in a direction toward the first end 22, enabling removal of the front follower 90 and then removal of the substantially spherical member 100 and the shaft member 110 and further enabling separation of adjacently disposed ends of a pair of railway cars (not shown). The wear of components may be measured visually or by way of conventional measuring devices (not shown).

While a pair of wedges have been found sufficient to provide wear compensation while reducing weight of the apparatus 10, it is within the scope of the present invention to provide a single wedge having a predetermined width.

In further reference to FIGS. 1-4, a male connection member, generally designated as 140, has a first end 142 thereof configured to be engaged with and connected to an adjacent predetermined end of a center sill member 4 disposed substantially along a longitudinal centerline of an opposed one of such pair of railway cars (not shown). A second end 144 thereof is secured to and substantially axially aligned with the first end 142 of the male connection member 140. A cavity 146 is formed within the second end 144 of the male connection member 140 for operably receiving the second end 114 of the shaft member 110, whereby the substantially spherical member 100 and the shaft member 110 enable rotational movement of the male connection member 140 relative to the female connection member 20 over a predetermined range. To axially secure the second end 114 of the shaft member 110 to the second end 144 of the male connection member 140, there is a pair of spaced apart apertures 147 which are formed within the second end 144 of the male connection member 140 and which are aligned with an annular groove 116 formed in the second end 114 of the shaft member 114 for operably receiving a pair of simple pins 150. Such connection enables the articulated coupling apparatus 10 to tolerate longitudinal pull forces present in operation of such pair of railway cars (not shown), while allowing rotational movement of the substantially spherical member 100 and the shaft member 110. The male connection member 140 may also include a lifting aperture 148.

According to one embodiment of the invention, each of the spherical cavity 96 of the front follower 90 and the spherical cavity 66 of the rear follower 60 has a substantially identical radius as a radius of the substantially spherical member 100.

According to another embodiment of the invention, a radius of each of the spherical cavity 96 of the front follower 90 and the spherical cavity 66 of the rear follower 60 is slightly larger than a radius of the substantially spherical member 100, and the articulated coupling apparatus 10 further includes a lubricating liner disposed intermediate each of the spherical cavity 96 of the front follower 90 and the spherical cavity 66 of the rear follower 60 and the substantially spherical member 100. Preferably, the lubricating liner is formed in two pieces which can be bonded by way of an adhesive to each of the spherical cavity 96 of the front follower 90 and the spherical cavity 66 of the rear follower 60.

Figure 9:
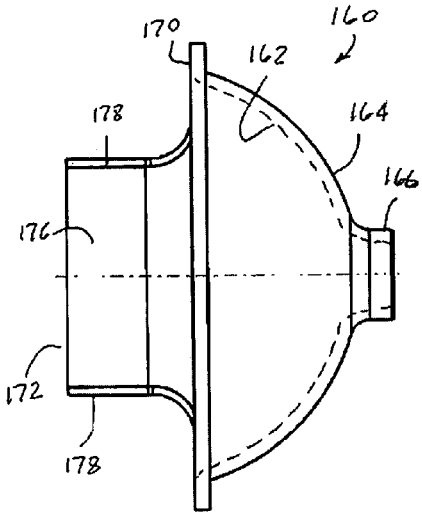
FIG. 9 is a top view of a first lubricating liner which is employed in the articulated coupling apparatus of FIG. 1 and which is positioned within a cavity of the rear follower of FIGS. 5-6.
Figure 10:
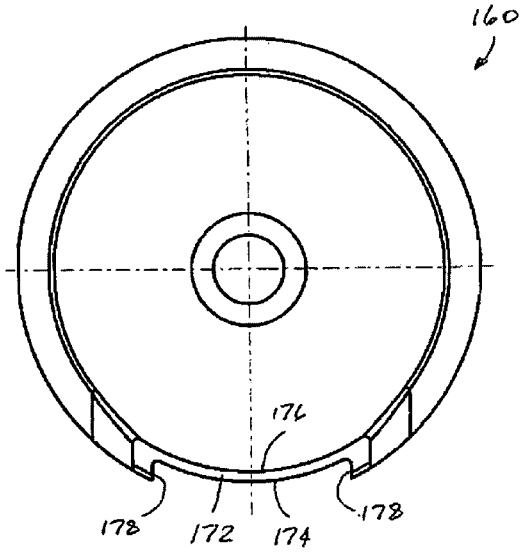
FIG. 10 is a front view of the rear follower of FIG. 9.

According to the presently preferred embodiment of the invention, each piece is removably positioned within a respective spherical cavity 66, 96. Thus, the present invention provides for a first lubricating liner 160 which is best shown in FIGS. 9-10, which is manufactured from a material having a low coefficient of friction and which is disposed intermediate the spherical cavity 66 of the rear follower 60 and the substantially spherical member 100. The first lubricating liner 160 has an inner spherical surface 162 having a radius which is about equal to the radius of the spherical member 100 and an outer spherical surface 164 having a radius which is about equal to the radius of the spherical cavity 66 of the rear follower 60. To facilitate positioning of the first lubricating liner 160 within the spherical cavity 66 of the rear follower 60, an annular ring 166 is formed on the outer spherical surface 164 of the first lubricating liner 160 and the rear follower 60 includes an aperture 78 which is axially formed therethrough and which is sized for operably receiving such annular ring 166. The first lubricating liner 160 further includes an annular flange 170 which abuts the front surface 64 of the rear follower 60 when the first lubricating liner 160 is positioned within the spherical cavity 66 of the rear follower 60.

The articulated coupling apparatus 10 of the present invention also includes means for preventing rotation of the first lubricating liner 160 during use. Preferably, such rotation preventing means includes a tab 80 which extends outwardly from the front surface 64 of the rear follower 60 in a direction towards the front follower 90. The tab 80 is adapted with a generally planar bottom surface 82 and a concave top surface 84. The generally planar bottom surface 82 abuts the inner surface of the bottom wall portion 44 of the second end 30 of the female connection member 20 and is essentially a continuation of the bottom surface 62 of the rear follower 60. The tab 80 has each of a predetermined width and a predetermined length. Complimentary to the tab 80, the first lubricating liner 160 includes a tab 172 which extends outwardly from a portion of a peripheral edge of the first lubricating liner 160 in a direction toward the front follower 90 when the first lubricating liner 160 is positioned within the spherical cavity 66 of the rear follower 60. The complimentary tab 172 has a bottom convex surface 174 which cooperates with the top concave surface 84 of the tab 80 of the rear follower 60. A concave top surface 176 of the complimentary tab 172 is sized for operably mating with the substantially spherical member 100. Advantageously, the concave top surface 176 prevents metal-to-metal contact of the substantially spherical member 100 during installation into the second end 30 of the female connection member 20. A pair of spaced elongated flanges 178 of the tab 172 extend downwardly in a direction toward the inner surface of the bottom wall portion 44 of the second end 30 of the female connection member 20 each abutting a respective side edge of the tab 80 of the rear follower 60 for preventing rotation of the first lubricating liner 160 being positioned within the spherical cavity 66 of the rear follower 60. Advantageously, a cutout 93 is formed in the bottom surface 92 of the front follower 90 to receive the combination of the tab 80 and the tab 172.

Figure 11:
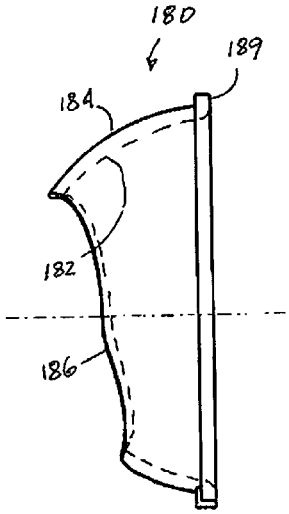
FIG. 11 is a side view of a second lubricating liner which is employed in the articulated coupling apparatus of FIG. 1 and which is positioned within a cavity of the front follower of FIGS. 7-8.
Figure 12:
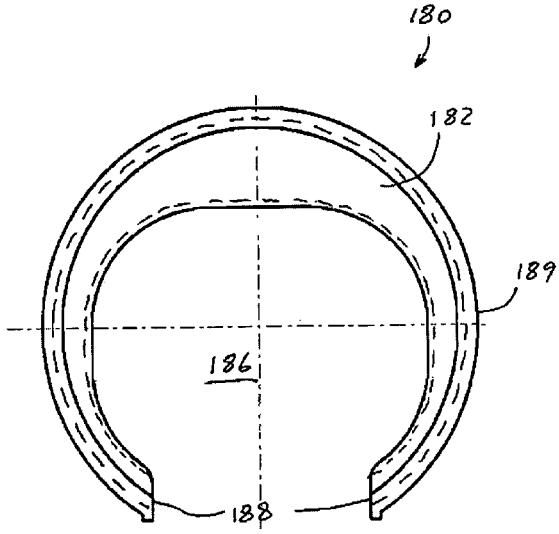
FIG. 12 is a front view of the second lubricating liner of FIG. 11.

Now in a particular reference to FIGS. 11-12, a second lubricating liner 180 is disposed intermediate the spherical cavity 96 of the front follower 90 and the substantially spherical member 100 and is disposed opposite the first lubricating liner 160 relative to the substantially spherical member 100. Similar to the first lubricating liner 160, the second lubricating liner 180 has an inner spherical surface 182 having a radius which is about equal to the radius of the spherical member 100 and the outer spherical surface 184 having a radius which is about equal to the radius of the spherical cavity 96 of the front follower 90. The second lubricating liner 180 has an aperture 186 which is formed through a wall portion thereof and which cooperates with the aperture 99 formed through the front follower 90 and the first aperture 38 formed through the planar wall portion 36 of the second end 30 when the second lubricating liner 180 is positioned within the spherical cavity 96 of the front follower 90. Thus, the shape of the aperture 186 is predetermined to allow the swivel motion of the shaft member 110 during movement of the pair of railway cars (not shown) around the curve. The width of the aperture 186 is about 8.5 inches and the height of the aperture 186 is about 6.5 inches. The thickness of each first lubrication liner 160 and the second lubricating liner 180 is about 0.25 inches.

The second lubricating liner 180 further has a cutout 188 which is sized for operatively receiving the tab 80 of the rear follower 60 and the tab 172 of the first lubricating liner 170 which then prevent rotation of such second lubricating liner 180 during use. A generally annular flange 189 is provided for abutment with a front surface 94 of the front follower 90 when the second lubricating liner 180 is positioned within the cavity 96 thereof.

It is also within the scope of the present invention to provide a simple cover 190 for covering the second aperture 42 which is formed through the top planar wall portion 40 of the second end 30 of the female connection member 20.

In operation, as the surfaces of the spherical cavity 96 of the front follower 90 and the spherical cavity 66 of the rear follower 60 deteriorate and wear during service, the wedges 120 descent downwardly, preferably due to gravity, and exert a force onto the rear follower 60 moving it axially in a direction toward the substantially spherical member 100 and further toward the front follower 90 to compensate for such wear condition and to further compensate for and prevent forming of a gap between the surfaces of the spherical cavities 66, 96 and the outer surface 102 of the substantially spherical member 100. Advantageously, the wedges 120 also compensate for manufacturing tolerances of the articulated coupling apparatus 10.

As, in accordance with the presently preferred embodiment of the invention, the substantially spherical member 100 is caged between the first lubricating insert 160 and the second lubricating insert 180, the male connection member 140 is allowed to swivel in relationship to the longitudinal axis of the articulated coupling apparatus 10 but is prevented from moving is a transitional fashion. Furthermore, the substantially spherical member 100 in combination with the shaft member 110, which is preferably formed integral therewith, provide for connecting means that connect female connection member 20 and the male connection member 140 during operation of the articulated coupling apparatus 10.

It will be apparent to those skilled in the art that articulated coupling apparatus 10 constructed according to the embodiments of the present invention provides enhanced performance during service, increases life cycle between retrofits, reduces installation effort of the articulated coupling apparatus 10, reduces uncoupling and coupling efforts and provides for ease of manufacturing and assembly of the articulated coupling apparatus 10 as compared with prior art articulated coupling arrangements.

It will be further apparent that employment of the first lubricating liner 160 and the second lubricating liner 180 which are removably positioned within respective spherical cavities 66 and 96 simplifies reconditioning effort of the articulated coupling apparatus 10 wherein such lubricating liners 160, 180 can be easily replaced without removal of either female connection member 20 or the male connection member 140 from their respective center sills 2, 4. Thus, the present invention reduces the reconditioning costs of the articulated coupling apparatus 10.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. An articulated coupling apparatus utilized in connecting together, in a substantially semi-permanent fashion, adjacently disposed ends of a pair of railway cars, said articulated coupling apparatus comprising:

(a) a female connection member including:

(i) a first end configured to be engaged with and connected to one predetermined end of a center sill member disposed substantially along a longitudinal centerline of one of the railway cars, (ii) an elongated hollow second end which is substantially axially aligned with said first end of said female connection member, said second end having a first portion which is secured to said first end of said female connection member and a second portion which is connected in open communication to said first portion and which extends axially therefrom in a direction away from said first end, (iii) a first aperture which is formed through a planar wall portion which closes said second portion of said second end and which is disposed generally vertically when said female connection member is installed for connecting such pair of railway cars and which is disposed generally perpendicular to the longitudinal centerline of one of the railway cars, said first aperture having each of a first predetermined size and a first predetermined shape, and (iv) a second aperture which is formed through a top planar wall portion of said second end, said second aperture having each of a second predetermined size and a second predetermined shape;

(b) a rear follower which is positioned within said second end of said female connection member adjacent to and spaced from said first end thereof, said rear follower having a bottom surface which abuttingly engages an inner surface of a bottom wall portion of said second end of said female connection member, a front surface which is disposed generally perpendicular to each of said bottom surface and such longitudinal centerline of such one of such pair of railway cars, a spherical cavity formed in said front surface, an opposed rear surface which is disposed towards said first end of said female connection member, and a pair of spaced apart tapered portions which are formed on said rear surface in spaced relationship from a top and said bottom surface of said rear follower and which are tapered at a predetermined angle downwardly and outwardly in a direction toward said first end of said female connection member;

(c) a front follower which is positioned within said second portion of said second end of said female connection member, said front follower having a bottom surface which abuttingly engages said inner surface of said bottom wall portion of said second end of said female connection member, a front surface which is disposed generally perpendicular to each of said bottom surface of said front follower and the longitudinal centerline of one of the railway cars, a spherical cavity formed in said front surface of said front follower, an opposed rear surface which abuttingly engages an inner surface of said planar wall portion which closes said second portion of said second end of said of said female connection member, and an aperture which is formed through said spherical cavity and through said rear surface of said front follower in general alignment with said first aperture of said second end of said female connection member;

(d) a substantially spherical member which is at least partially positioned in operable relationship within said spherical cavity formed in said front follower and said spherical cavity formed in said rear follower;

(e) a shaft member having a first end thereof disposed on and secured to a portion of an outer surface of said substantially spherical member, said shaft member axially extending outwardly from said outer surface of said substantially spherical member through each of said aperture formed through said spherical cavity and through said rear surface of said front follower and said first aperture of said second end of said female connection member, said shaft member having an opposed second end thereof being positioned external to said female connection member;

(f) a pair of wedges each having a top end, a bottom end which is spaced from said inner surface of said bottom wall portion of said second end of said female connection member, a tapered front surface connecting said top and bottom ends and cooperatively engaging a respective one of said pair of spaced apart portions which are formed on said rear surface of said rear follower and a rear surface connecting said top and bottom ends and abuttingly engaging an inner surface of a wall portion of said first portion of said female connection member which engages said first end of said female connection member, said pair of wedges descending downwardly during use to force said rear follower and said substantially spherical member in a direction toward said front follower and to compensate for longitudinally axial clearances forming due to wear of at least one of said substantially spherical member, said spherical cavity of front follower and said spherical cavity of said rear follower;

(g) a male connection member having a first end thereof configured to be engaged with and connected to an adjacent predetermined end of a center sill member disposed substantially along a longitudinal centerline of an opposed one of such pair of railway cars, a second end thereof secured to and substantially axially aligned with said first end of said male connection member, and a cavity formed within said second end of said male connection member for operably receiving said second end of said shaft member, whereby said substantially spherical member and said shaft member enable a swivel movement of said male connection member relative to said female connection member in both a vertical direction and a horizontal direction over a predetermined range;

(h) an annular groove provided on a peripheral outer surface of said second end of said shaft member in a plane transverse to a longitudinal axis thereof;

(i) a pair of spaced apart apertures formed through said second end of said male connection member in alignment with said annular groove; and (j) a pair of pins, each of said pair of pins passed through a respective combination of said pair of spaced apart apertures and said annular groove.

2. The apparatus, according to claim 1, wherein said bottom wall portion of said second end of said female connection member includes a center plate member which matingly engages a center bowl of a bolster portion of a railway car truck.

3. The apparatus, according to claim 2, wherein said female connection member includes at least one aperture which is formed through said bottom wall portion for draining liquid matter from said female connection member.

4. The apparatus, according to claim 1, wherein said female connection member includes an aperture which is formed in at least one of side wall portions of said first portion of said second end and which is positioned adjacent and spaced from said bottom wall portion of said second end for facilitating removal of said wedges and for measuring said wear of said at least one of said substantially spherical member, said spherical cavity of said front follower and said spherical cavity of said rear follower.

5. The apparatus, according to claim 1, wherein each of said spherical cavity of said front follower and said spherical cavity of said rear follower has a substantially identical radius as a radius of said substantially spherical member.

6. The apparatus, according to claim 1, wherein a radius of each of said spherical cavity of said front follower and said spherical cavity of said rear follower is slightly larger than a radius of said substantially spherical member, and said apparatus further includes a lubricating liner disposed intermediate each of said spherical cavity of said front follower and said spherical cavity of said rear follower and said substantially spherical member.

7. The apparatus, according to claim 6, wherein said lubricating liner is formed in two pieces.

8. The apparatus, according to claim 1, wherein a radius of each of said spherical cavity of said front follower and said spherical cavity of said rear follower is slightly larger than a radius of said substantially spherical member, and said apparatus further includes a first lubricating liner which is disposed intermediate said spherical cavity of said rear follower and said substantially spherical member, said first lubricating liner having each of an inner and an outer spherical surface.

9. The apparatus, according to claim 8, wherein said first lubricating liner includes an annular ring axially formed on said rear surface thereof and wherein said rear follower includes an aperture which is axially formed therein and which is sized for operably receiving said annular ring of said first lubricating liner.

10. The apparatus, according to claim 8, wherein said first lubricating liner includes an annular flange abutting said front surface of said rear follower when said first lubricating liner is positioned within said spherical cavity thereof.

11. The apparatus, according to claim 8, wherein said rear follower includes a tab which extends outwardly from said front surface of said rear follower in said direction toward said front follower, said tab having a generally planar bottom surface which abuts said inner surface of said bottom wall portion of said second end of said female connection member and a concave upper surface, said tab having each of a predetermined width and a predetermined length, and wherein said first lubricating liner includes a complimentary tab which extends outwardly from a portion of a peripheral edge of said first lubricating liner in said direction toward said front follower when said first lubricating liner is positioned within said spherical cavity of said rear follower, said complimentary tab having a bottom convex surface which is sized to cooperate with said top concave surface of said tab of said rear follower and a pair of flanges which extend downwardly in a direction toward said inner surface of said bottom wall portion of said second end of said female connection member each abutting a respective side edge of said tab of said rear follower for preventing rotation of said first lubricating liner being positioned within said spherical cavity of said rear follower.

12. The apparatus, according to claim 11, wherein said apparatus further includes a second lubricating liner which is disposed intermediate said spherical cavity of said front follower and said substantially spherical member, said second lubricating liner having an aperture which is formed through a wall portion thereof and which cooperates with said aperture formed through said front follower when said second lubricating liner is positioned within said spherical cavity of said front follower, said second lubricating liner further having cutout which is formed in a wall portion thereof for receiving a combination of said tab of said rear follower and said tab of said first lubricating liner.

13. The apparatus, according to claim 1, wherein said rear follower includes a tab which is formed on a top surface thereof and which extends outwardly from said top surface and an aperture formed through said tab for releaseably attaching said rear follower to a lifting implement employed when said rear follower is installed into or removed from said second end of said female connection member.

14. The apparatus, according to claim 1, wherein said rear follower includes a pair of spaced apart flanges disposed on and secured to said rear surface of said rear follower, each positioned adjacent an interior side edge of a respective one of said pair of tapered portions and wherein said each wedge is caged transversely between a respective flange and a respective inner surface of a side wall portion of said first portion of said second end of said female connection member.

15. The apparatus, according to claim 1, wherein said each wedge includes a tab which is formed on said top end thereof and which extends outwardly from said top end and an aperture formed through said tab for releaseably attaching said each wedge to a lifting implement employed when said each wedge is installed into or removed from said second end of said female connection member.

16. The apparatus, according to claim 1, wherein said apparatus further includes a cover for releaseably covering said second aperture of said second end of said female connection member.

17. The apparatus, according to claim 1, wherein said means for securing said second end of said shaft member to said male connection member includes an annular groove formed in said second end of said shaft member, a pair of spaced apart apertures formed through a predetermined portion of said second end of said male connection member and a pair of pins each operably received within said annular grove and within a respective aperture.

18. A lubricating liner for an articulated coupling apparatus utilized in connecting together, in a substantially semi-permanent fashion, adjacently disposed ends of a pair of railway cars, said lubricating liner comprising an inner spherical surface, an outer spherical surface disposed concentric with said inner spherical surface and spaced apart therefrom along an axis of said lubricating liner to define each of a thickness and a peripheral edge thereof, and an annular ring axially formed on said outer spherical surface of said lubricating liner and a flange upstanding at said peripheral edge thereof in a plane transverse to said axis.

19. The lubricating liner, according to claim 18, wherein said lubricating liner includes a tab which extends outwardly from a portion of said peripheral edge of said lubricating liner, said tab having a bottom convex surface, a top concave portion disposed concentrically with said bottom convex surface, and a pair of flanges which extend therefrom.

20. A lubricating liner for an articulated coupling apparatus utilized in connecting together, in a substantially semi-permanent fashion, adjacently disposed ends of a pair of railway cars, said lubricating liner comprising an inner spherical surface, an outer spherical surface disposed concentric with said inner spherical surface, an aperture formed through a wall portion formed by said inner spherical surface and said outer spherical surface, said aperture disposed in a generally vertical plane transverse to a longitudinal axis of said pair of railway cars when said lubricating liner is installed into said articulated coupling apparatus, and a cut-out formed through said wall portion in open communication with each of said aperture and a peripheral edge of said lubricating liner.

21. An articulated coupling apparatus utilized in connecting together, in a substantially semi-permanent fashion, adjacently disposed ends of a pair of railway cars, said articulated coupling apparatus comprising:

(a) a female connection member including:

(i) a first end configured to be engaged with and connected to one predetermined end of a center sill member disposed substantially along a longitudinal centerline of one of the railway cars, (ii) an elongated hollow second end aligned substantially axially with said first end of said female connection member, said second end having a first portion which is secured to said first end of said female connection member and a second portion which is connected in open communication to said first portion and which extends axially therefrom in a direction away from said first end, (iii) a first aperture formed through a planar wall portion which closes said second portion of said second end and which is disposed generally vertically when said female connection member is installed for connecting such pair of railway cars and which is disposed generally perpendicular to the longitudinal centerline of one of the railway cars, said first aperture having each of a first predetermined size and a first predetermined shape, and (iv) a second aperture formed through a top planar wall portion of said second end, said second aperture having each of a second predetermined size and a second predetermined shape;

(b) a front follower positioned within said second portion of said second end of said female connection member, said front follower having each of a bottom surface thereof abuttingly engaging said inner surface of said bottom wall portion of said second end of said female connection member, a front surface thereof disposed generally perpendicular to each of said bottom surface of said front follower and the longitudinal centerline of one of the railway cars, a spherical cavity formed in said front surface of said front follower, an opposed rear surface thereof abuttingly engaging an inner surface of said planar wall portion which closes said second portion of said second end of said of said female connection member, and an aperture formed through said spherical cavity and through said rear surface of said front follower in general alignment with said first aperture of said second end of said female connection member;

(c) a rear follower positioned within said second end of said female connection member adjacent to and spaced from said first end thereof, said rear follower having each of a bottom surface thereof abuttingly engaging an inner surface of a bottom wall portion of said second end of said female connection member, a front surface thereof disposed generally perpendicular to each of said bottom surface and such longitudinal centerline of such one of such pair of railway cars, a spherical cavity formed in said front surface, an opposed rear surface thereof disposed towards said first end of said female connection member, a pair of spaced apart tapered portions provided on said rear surface in spaced relationship from a top and said bottom surface of said rear follower and tapered at a predetermined angle downwardly and outwardly in a direction toward said first end of said female connection member, an aperture axially formed therethrough, and a tab extending outwardly from said front surface of said rear follower in a direction toward said front follower;

(d) a first lubricating liner disposed within said spherical cavity of said rear follower, said first lubricating liner having each of an annular ring axially formed on a rear surface thereof and sized to be received within said aperture of said rear follower and a tab extending outwardly from a portion of a peripheral edge of said first lubricating liner in said direction toward said front follower;

(e) a second lubricating liner disposed within said spherical cavity of said front follower, said second lubricating liner having an aperture formed through a wall portion thereof and cooperating with said aperture formed through said front follower, said second lubricating liner further having cutout formed in said wall portion thereof for receiving a combination of said tab of said rear follower and said tab of said first lubricating liner;

(f) a substantially spherical member which is at least partially positioned in operable relationship between said first and second lubricating liners;

(g) a shaft member having a first end thereof disposed on and secured to a portion of an outer surface of said substantially spherical member, said shaft member axially extending outwardly from said outer surface of said substantially spherical member through each of said aperture formed through said spherical cavity and through said rear surface of said front follower and said first aperture of said second end of said female connection member, said shaft member having an opposed second end thereof being positioned external to said female connection member;

(h) a pair of wedges each having a top end, a bottom end which is spaced from said inner surface of said bottom wall portion of said second end of said female connection member, a tapered front surface connecting said top and bottom ends and cooperatively engaging a respective one of said pair of spaced apart portions which are formed on said rear surface of said rear follower and a rear surface connecting said top and bottom ends and abuttingly engaging an inner surface of a wall portion of said first portion of said female connection member which engages said first end of said female connection member, said pair of wedges descending downwardly during use to force said rear follower and said substantially spherical member in a direction toward said front follower and to compensate for longitudinally axial clearances forming due to wear of at least one of said substantially spherical member, said spherical cavity of front follower and said spherical cavity of said rear follower;

(i) a male connection member having a first end thereof configured to be engaged with and connected to an adjacent predetermined end of a center sill member disposed substantially along a longitudinal centerline of an opposed one of such pair of railway cars, a second end thereof secured to and substantially axially aligned with said first end of said male connection member, and a cavity formed within said second end of said male connection member for operably receiving said second end of said shaft member, whereby said substantially spherical member and said shaft member enable a swivel movement of said male connection member relative to said female connection member in both a vertical direction and a horizontal direction over a predetermined range; and (j) whereby an opposed second end of said shaft member is secured for rotation within said cavity of said male connection member.

* * * * *